US006609617B1

(12) United States Patent
Slayer et al.

(10) Patent No.: US 6,609,617 B1
(45) Date of Patent: Aug. 26, 2003

(54) TROMMEL

(75) Inventors: Ralph Edward Slayer, Oakville (CA); Barry Ross Bowerman, Lively (CA); Kenneth Erwin Scholey, Sudbury (CA)

(73) Assignee: Inco Limited, Toronto (CA)

( * ) Notice: Subject to any disclaimer, the term of this patent is extended or adjusted under 35 U.S.C. 154(b) by 0 days.

(21) Appl. No.: 10/118,194

(22) Filed: Apr. 8, 2002

(51) Int. Cl.[7] ..... B07B 1/24

(52) U.S. Cl. ..... 209/379; 209/664; 209/668; 209/393; 209/394; 209/395

(58) Field of Search ..... 209/379, 664, 209/287, 668, 393, 394, 395, 788, 409, 410, 411

(56) References Cited

U.S. PATENT DOCUMENTS

| | | | | | |
|---|---|---|---|---|---|
| 385,071 | A | * | 6/1888 | Roberts | 171/129 |
| 546,447 | A | * | 9/1895 | Grugin | 209/394 |
| 883,974 | A | | 4/1908 | Roughsedge | |
| 1,343,292 | A | * | 6/1920 | Turner | 209/393 |
| 2,984,351 | A | | 5/1961 | Van Slyck et al. | 209/98 |
| 3,055,500 | A | | 9/1962 | Aubert-Maguero | 209/288 |
| 3,241,667 | A | * | 3/1966 | Grosbety | 209/664 |
| 3,805,952 | A | * | 4/1974 | Pleus | 209/664 |
| 4,049,124 | A | * | 9/1977 | Coppolani et al. | 209/664 |
| 5,165,548 | A | * | 11/1992 | Dumler et al. | 209/2 |
| 5,332,103 | A | | 7/1994 | Zittel | 209/664 |
| 5,620,101 | A | * | 4/1997 | Andela et al. | 209/288 |
| 6,360,894 | B1 | | 3/2002 | Devlin et al. | 209/291 |

FOREIGN PATENT DOCUMENTS

| | | |
|---|---|---|
| EP | 0265421 | 10/1987 |
| FR | 1449000 | 6/1965 |
| RU | 1238808 | 12/1984 |

* cited by examiner

*Primary Examiner*—Donald P. Walsh
*Assistant Examiner*—Jonathan R Miller
(74) *Attorney, Agent, or Firm*—Edward A. Steen

(57) ABSTRACT

A trommel for classifying and sorting objects. The trommel is an open cylinder including a drive plate and a feed plate. A series of supporting rods extend between the drive plate and the feed plate. Disposed therebetween is a rod support ring dividing the trommel into a classifying zone and a discharge zone. A plurality of vibrating rods, floating in the vicinity of the rod support ring and anchored to the feed plate, oscillate and flex as the trommel rotates causing preselected sized objects to pass through the vibrating and support bars while the remaining objects are passed into the discharge zone with reduced clogging.

18 Claims, 8 Drawing Sheets

TROMMEL

TECHNICAL FIELD

The present invention relates to classifying equipment in general, and more particularly, to an apparatus that separates preselected undersize object fractions, such as chunks, pellets, briquettes, aggregate, rocks, grain, seeds and the like from preselected oversized object fractions of the same or differing material.

BACKGROUND OF THE INVENTION

Classifying devices are utilized to sort, grade and separate diverse sizes of commingled solids in a myriad of applications.

A relatively simple sorting device is represented by a screen. Depending on the chosen spacing of the mesh, a percentage of the solids of a desired maximum size are permitted to pass whereas the remaining larger components are restrained. Vibratory screens or grizzlies expedite the sorting process. Screens are prone to debilitating plugging and downtime.

For classifying larger objects, rotating drums having circumferentially spaced longitudinal bars permit desired sized objects to pass through the spacing of the bars for collection whereas the remaining larger articles continue through the drum.

Improvements to drum classifiers generally relate to complex mechanical mechanisms for moving the bars.

Representative designs include U.S. Pat. No. 2,984,351 to Van Slyck et al. wherein a plurality of sizing tubes or bars are rotatably mounted within rings.

U.S. Pat. No. 3,055,500 to Aubert-Maguero discloses a cylindrical cage having variable gaps between the bars to free jammed articles.

Bean graders of the type disclosed in U.S. Pat. No. 3,241,667 to Grosbety and U.S. Pat. No. 5,332,103 to Zittel disclose rotating drums having spring loaded spacing mechanisms for bars and rotatable grader bars respectively.

SU 1238-808 appears to be classifying drum suspended by springs.

U.S. Pat. No. 883,974 to Roughsedge discloses a rotating drum having rigid bars alternating with shiftable free bars constrained in space rings. The larger fractions are caused to erosively flow over an inner space ring as the drum rotates.

Applicants' previous experience with a stationary grizzly resulted in significant exasperating and expensive downtime. Assignee produces carbonyl nickel pellets. Fused nickel pellet chunks (called "elephants") tended to clog up the grizzly wire screens upon their exit from a furnace. The operation had to be repeatedly stopped and the plugging elephants physically removed by hand. A review of drum designs revealed complicated mechanical classifiers (such as those referenced above) that would be expected to experience periodic jamming in dusty and dirty industrial environments.

SUMMARY OF THE INVENTION

There is provided a refreshingly simple but robust drum classifier or trommel that easily divides solids into larger and smaller sized fractions in a demanding duty environment.

The trommel is an open cylinder including a plurality of longitudinal rods extending between two opposed end plates. The ends of a plurality of selected shorter rods are affixed to one end plate whereas the opposing unattached ends of these selected rods float in an opposing ring disposed between the two end plates. As the drum rotates and the objects impact all of the rods, the selected rods oscillate and vibrate in essentially infinite degrees of freedom so as to continuously alter their spaced relationship with each other as well as their fixed rod neighbors. The infinitely continuous vibrating motion size screens the objects with reduced plugging.

PREFERRED EMBODIMENT OF THE INVENTION

Figure 1:
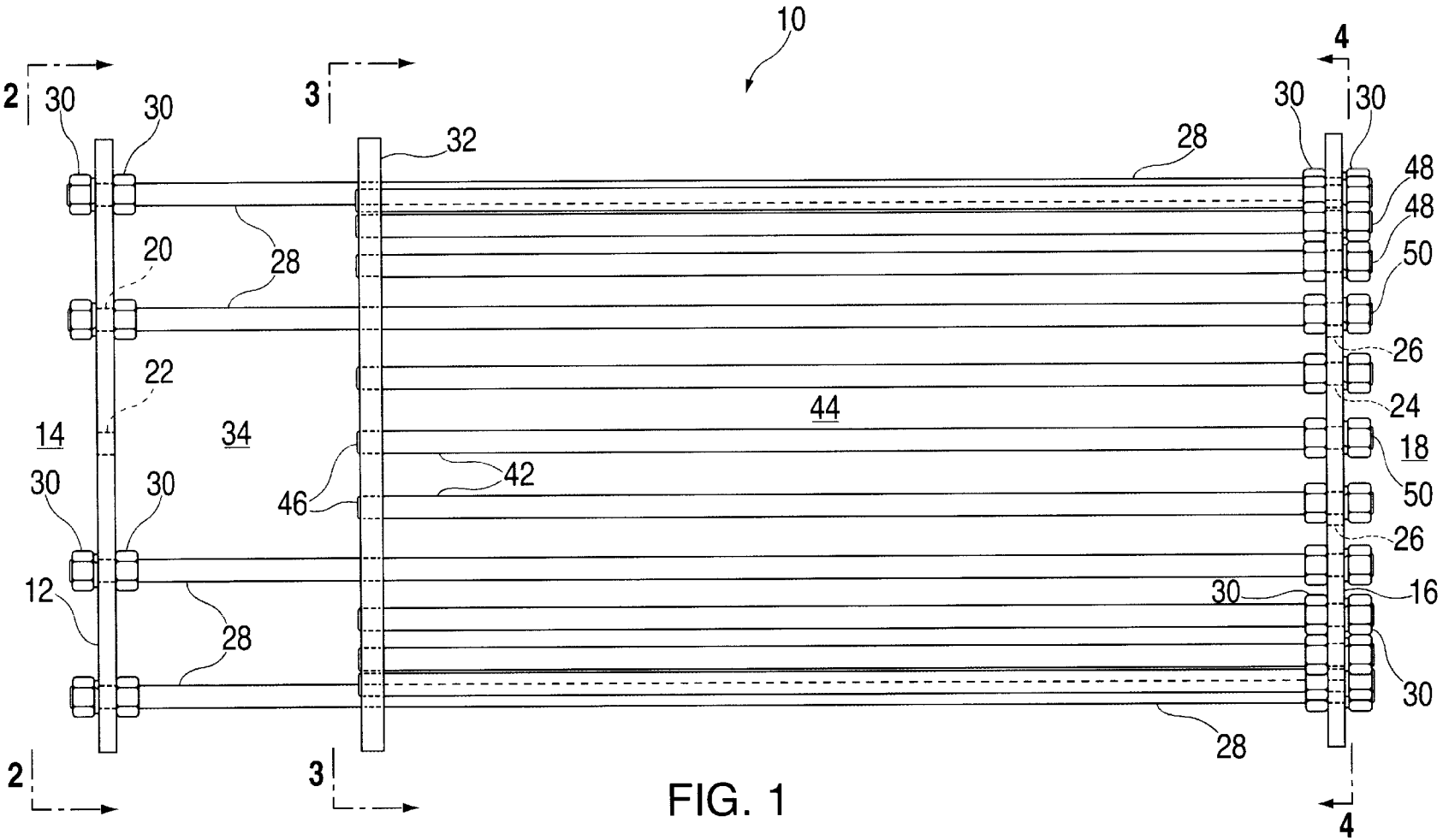
FIG. 1 is an elevation of an embodiment of the invention.

Referring to FIG. 1 there is shown a trommel 10. The trommel 10 includes drive plate 12 located at the distal end 14 of the trommel 10. A feed plate 16 is disposed at the proximal end 18 of the trommel 10.

The terms 'distal" and "proximal" are arbitrary conventions useful for ease of discussion. They are not to be construed as limiting.

Figure 2:
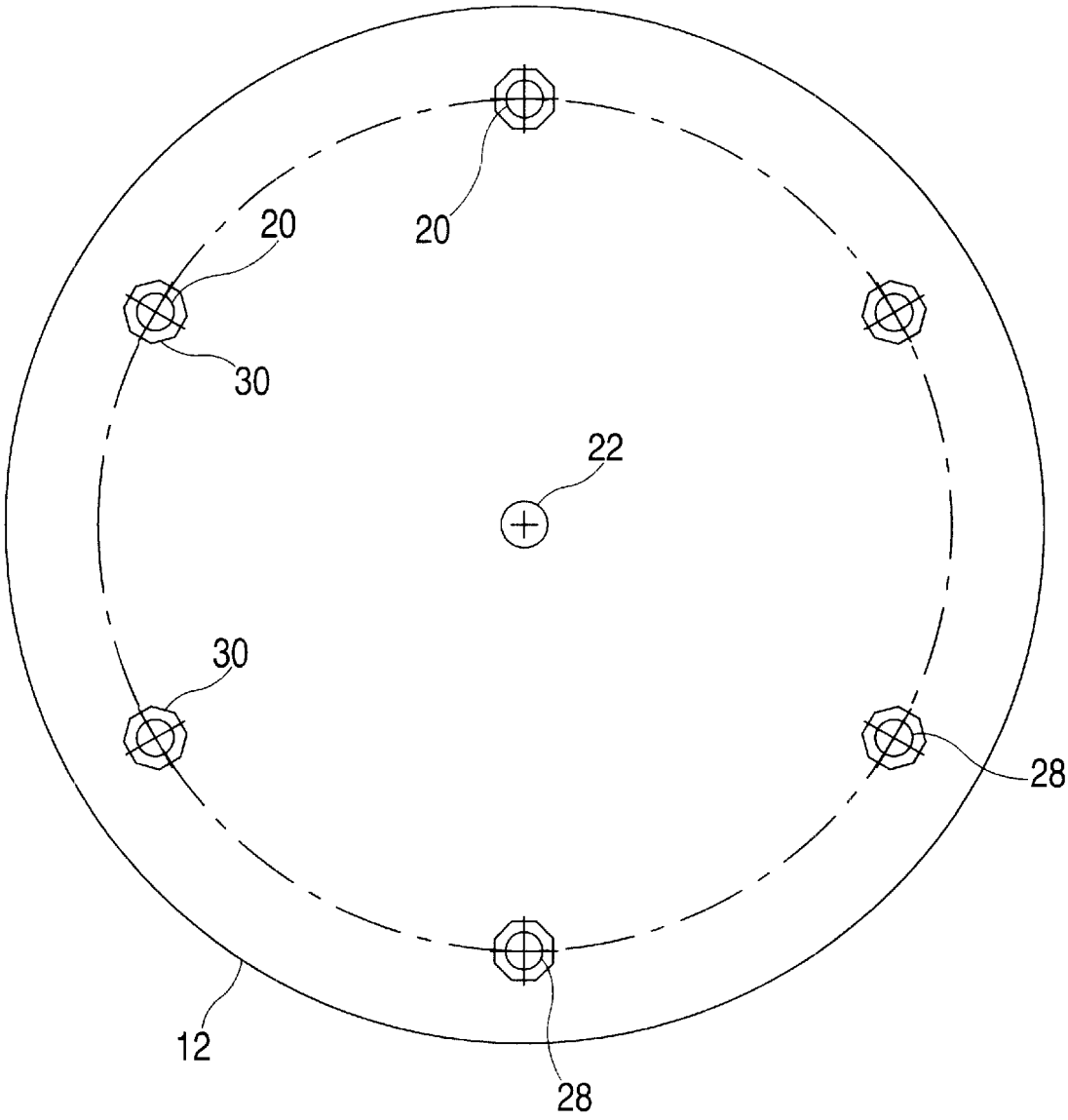
FIG. 2 is a view taken along line 2—2 in FIG. 1.

The drive plate 12 includes a plurality of spaced circumferentially disposed feed plate holes 20 and a center drive hole 22. See also FIG. 2.

Figure 4:
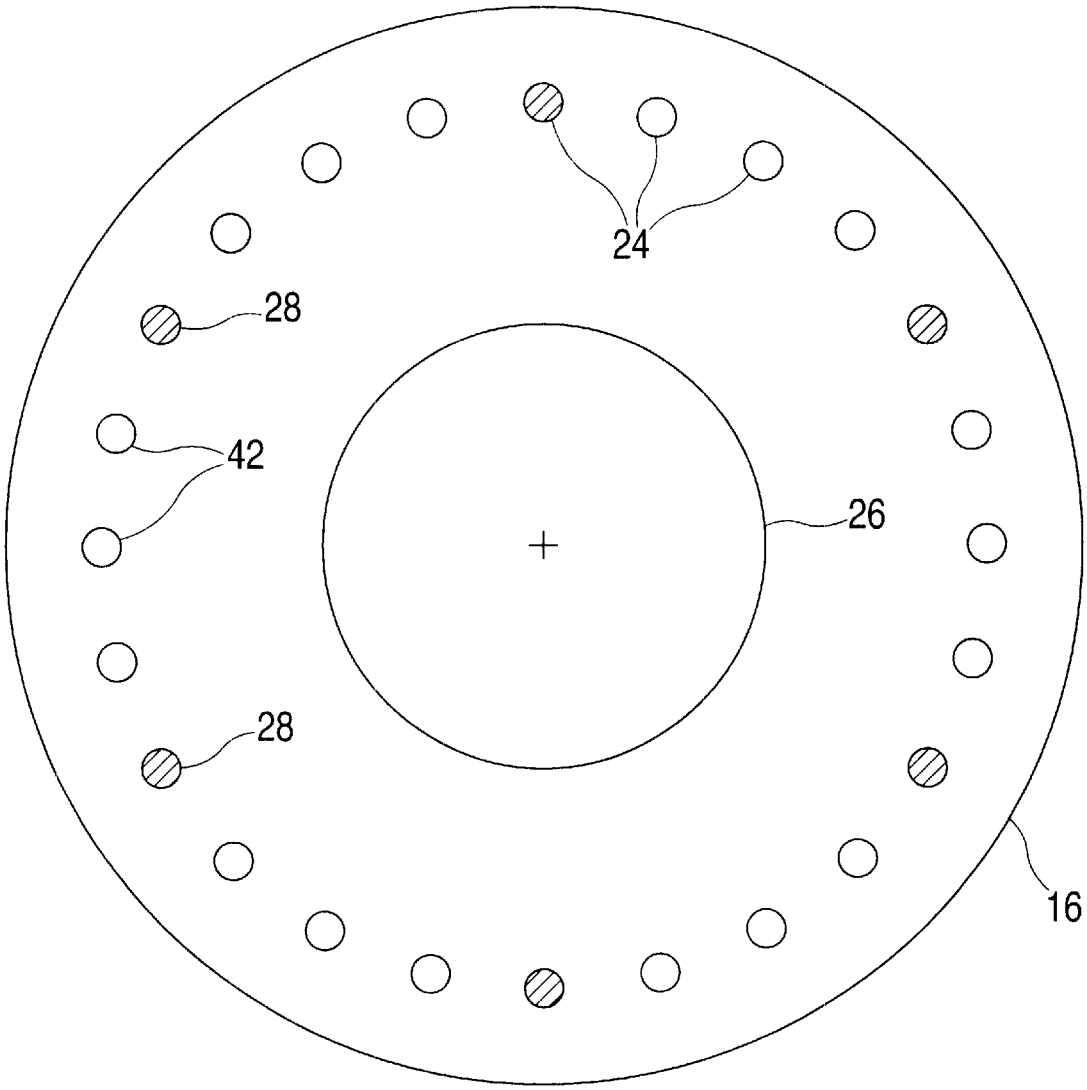
FIG. 4 is a view taken along line 4—4 in FIG. 1.

The feed plate 16 includes plurality of circumferentially disposed drive plate holes 24 and a center opening 26. See also FIG. 4.

A plurality of spaced supporting rods 28 extend longitudinally between the drive plate 12 and the feed plate 16 to form a substantially open drum cage. Although the supporting rods 28 are shown fastened to the plates 12 and 16 by double nuts 30 with lock washes (not shown), other attachment means such as welds, rivets, swaged ends, etc. may be used. Nuts 30 permit relatively easy assembly and disassembly whereas other fastening means are more permanent in nature. When using the nuts 30, the ends of the supporting rods 28 are threaded (not shown).

A rod support ring 32 is disposed between the distal and proximal ends 14 and 18 of the trommel 10 simultaneously forming classifying zone 44 and discharge zone 34. The location of the rod support 32 and hence the respective sizes of the classifying zone 44 and the discharge zone 34 may be selected as conditions and classifying needs change.

Figure 3:
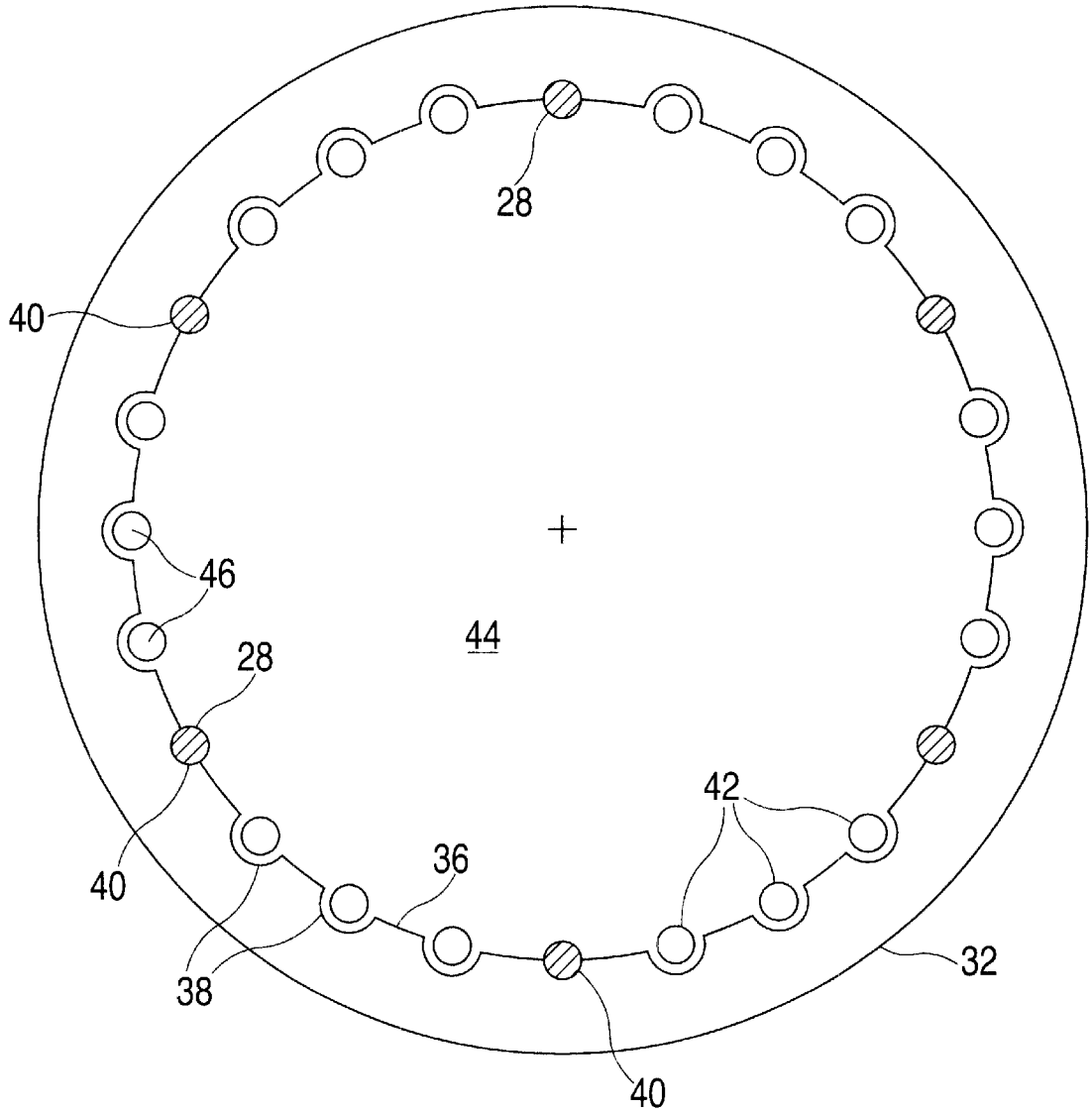
FIG. 3 is a view taken along line 3—3 in FIG. 1.

Turning to FIG. 3, the rod support ring 32 includes an inner surface or race 36 having a plurality circumferentially spaced first scallops 38 of a predetermined diameter. Interspaced between the first scallops 38 are a series of circumferentially spaced second scallops 40. The second scallops 40 cradle the supporting rods 28 which may be welded or press fitted to the inner race 36. The supporting rods 28 essentially extend over the entire length of the trommel 10.

A plurality of spaced vibratory rods 42 longitudinally bridge the classifying zone 44 of the trommel 10 formed between the rod support ring 32 and the feed plate 16.

The distal ends 46 of the vibrating rods 42 rest on or are spaced above the first scallops 38 but are not affixed to them. Collectively, the unrestrained distal ends 46 of the rods 42 are free to "float." The opposing proximal ends 48 of the vibrating rods 42 are anchored to the feed plate 16. Again, double nuts 30 are preferred but other fastening means are acceptable.

In operation, the trommel 10 rotates as the objects are introduced into the classifying zone 44 through the center opening 26 of the feed plate 16. A motor 68 and shaft 66 arrangement may be used. See FIG. 6. Other means for rotating the trommel 10, such as belts or external ring gears (not shown) may also be employed.

It should be appreciated that the distal ends 46 of the vibrating rods 42 are unconstrained and are free to float and oscillate within and about the first scallops 38 and the inner race 36. For emphasis, the distal ends 46 are shown spaced away from the first scallops 38. However, the distal ends 46 may be spaced away, resting within the first scallops 38 or in a varied alternating relationship with the first scallops 38. The critical consideration is that the free distal ends 46 of the rods 42 are permitted to float or move within or without the first scallops 38. As the trommel 10 rotates and solids of varying size, shape and hardness tumble within the classifying section 44, the spacing between the vibrating rods 42 themselves and the supporting rods 28 is constantly changing. This continuous movement classifies the articles while simultaneously reducing clogging.

By partially embedding the supporting rods 28 and the vibrating rods 42 into the inner race 36 of the support ring 32 little or no obstructions are presented to the larger objects entering into the discharge zone 34. The low profile of these components permits a free flowing flow path so the objects can easily cascade over the rod support ring 32 into the disclosure with reduced wear and tear.

By anchoring the proximal ends 48 of the vibrating rods 42 while letting the distal ends 46 float, the vibrating rods 42 will continuously flex like tuning forks while constantly altering the spaced relationship between themselves and their neighboring supporting rods 28 within a specified range thusly allowing preselected maximum sizes of objects to fall between the spacing of the rods 28 and 42.

The quantities of supporting rods 28 and the vibrating rods 42 and their physical relationships may be varied as necessary. Moreover, repeated or random combinations of the rods 28 and 42 may be used. In the non-limiting successful prototype trommel 10 depicted in the figures, the trommel 10 is 28 inches (71.1 cm) long and 14 inches (35.6 cm) in diameter. The discharge zone 34 is 6 inches (15.2 cm) long The rods 28 and 42 are 0.5 inches (1.3 cm) in diameter, 1 inch (2.5 cm) apart and 15 ° offset from one another. The inner diameter of the rod support ring 32 is 11.47 inches (29.1 cm). The opening 26 is 5.75 inches (74.6 cm) in diameter. The first scallops 38 have a 0.25 inch (0.64) cm) radius cut whereas the second scallops 40 have a 0.375 (0.96 cm) radius cut so as to allow a 0.125 inch (0.32 cm) float tolerance.

By selectively configuring the spacing and number of rods 28 and 42 and the size of the classifying and discharge zones 44 and 34, the trommel 10 may be scaled to classify objects into various size fractions with relatively close tolerances.

As the feed is introduced into the opening 26, the tumbling action along with the infinite vibratory action of the floating vibrating rods 42 will cause the smaller objects in the classifying zone 44 to fall between the rods whereas the larger pieces will cascade over the unobstructive inner scalloped race 36 into the discharge zone 34.

Figure 5:
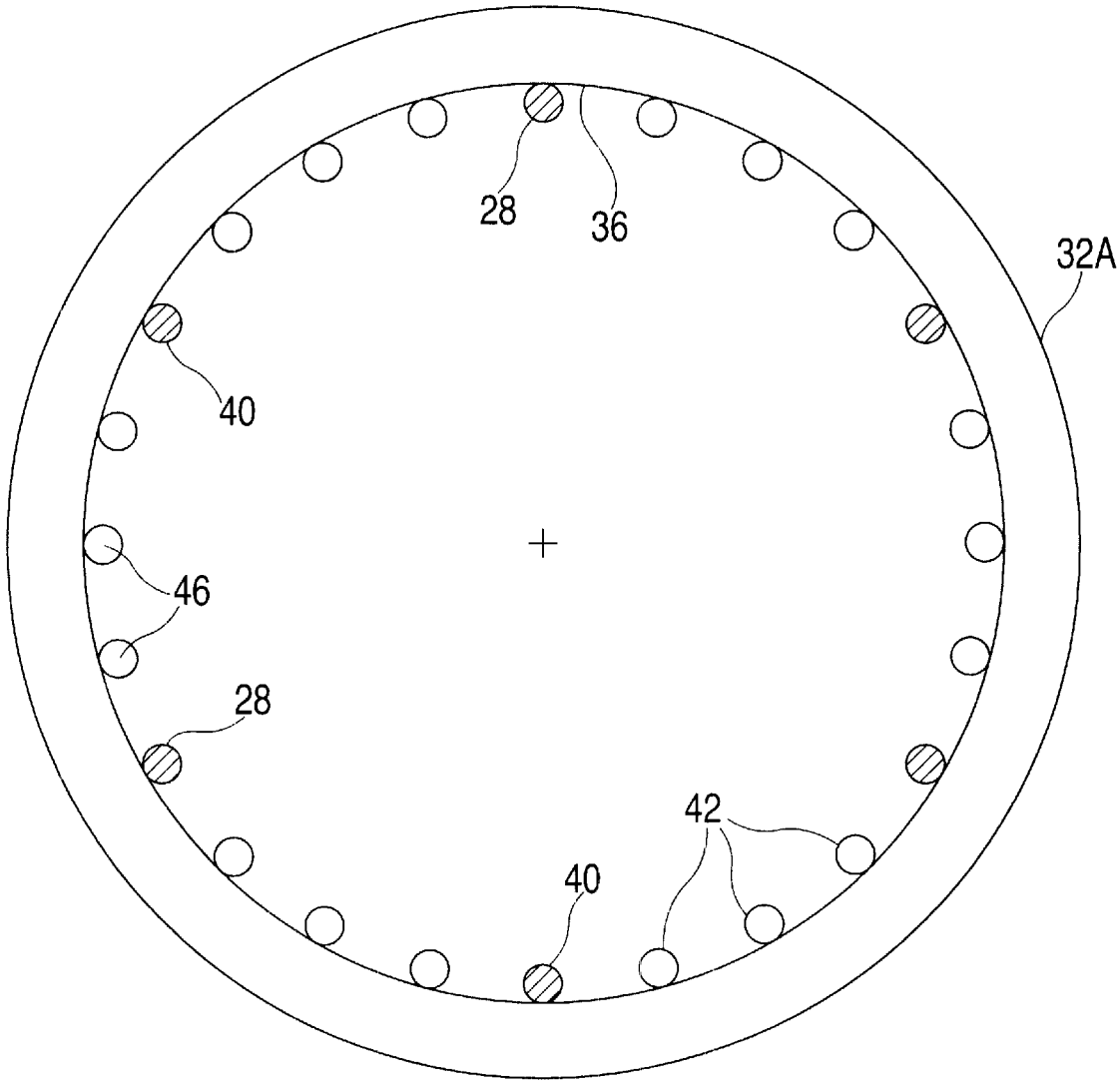
FIG. 5 is a view of an alternative embodiment of the invention.

Turning to FIG. 5, there is shown an alternative rod support ring 32A. It is lower cost embodiment in that there are no scallops 38 and/or 40. Machining costs for the scalloping of the ring 32A are eliminated. The distal ends 46 of the vibrating rods 42 are still free to float since they simply rest on the inner ring surface 36. The supporting rods 28 are affixed, preferably by welding, to the inner surface of the rod support ring 32A.

As in the case of the rod support ring 32, both sets of the rods 28 and 42 present, in alternative rod support ring 32A, a free flowing unobstructed path for the objects to cascade into the discharge zone 34.

The design proposed in U.S. Pat. No. 883,974 to Roughedge presents several mechanical disadvantages. In a test prototype, using various sized pellets, and having dimensions similar to those of the trommel 10 above, it was determined the corresponding rod support ring (tail ring $K^1$) creates a physical dam ("tire-like hoops "$B^4$ and "$B^5$") that the pellets must negotiate up and over. This impedes pellet flow and engenders eventual erosion from the particles' continuous physical impacts. The present trommel 10, however, projects a relatively smooth flow path for the objects over the inner race 36 since all of the rods 28 and 42 are at least partially embedded in the scallops 38 and 40. Or, in the alternative, adjacent to the inner race 36 as shown in FIG. 5.

Moreover, since US '974's bars $B^2$ are free to move and turn in the oblong openings 3 at both ends, the open longitudinal space that the smaller pellets pass through is not equal when the unit turns. This produces a poor size fraction distribution because these bars are forced to the side during operation causing alternating wide and narrow gaps.

In tests of the US '974 design, the maximum feed rate attained was 52.5 tonnes (52,500 kg) per hour but virtually all the pellets passed through the bars and only 0.15% of the pellets discharged into the oversized fraction. This clearly is not a desirable amount with the present invention where 10% oversized fractions are expected.

Finally, the present invention enables more control of the pellet size fractions because the multiple vibratory bars 42 flex at one end with minimal radial motion to prevent plugging. There is also less physical wear on the trommel 10.

Figure 6:
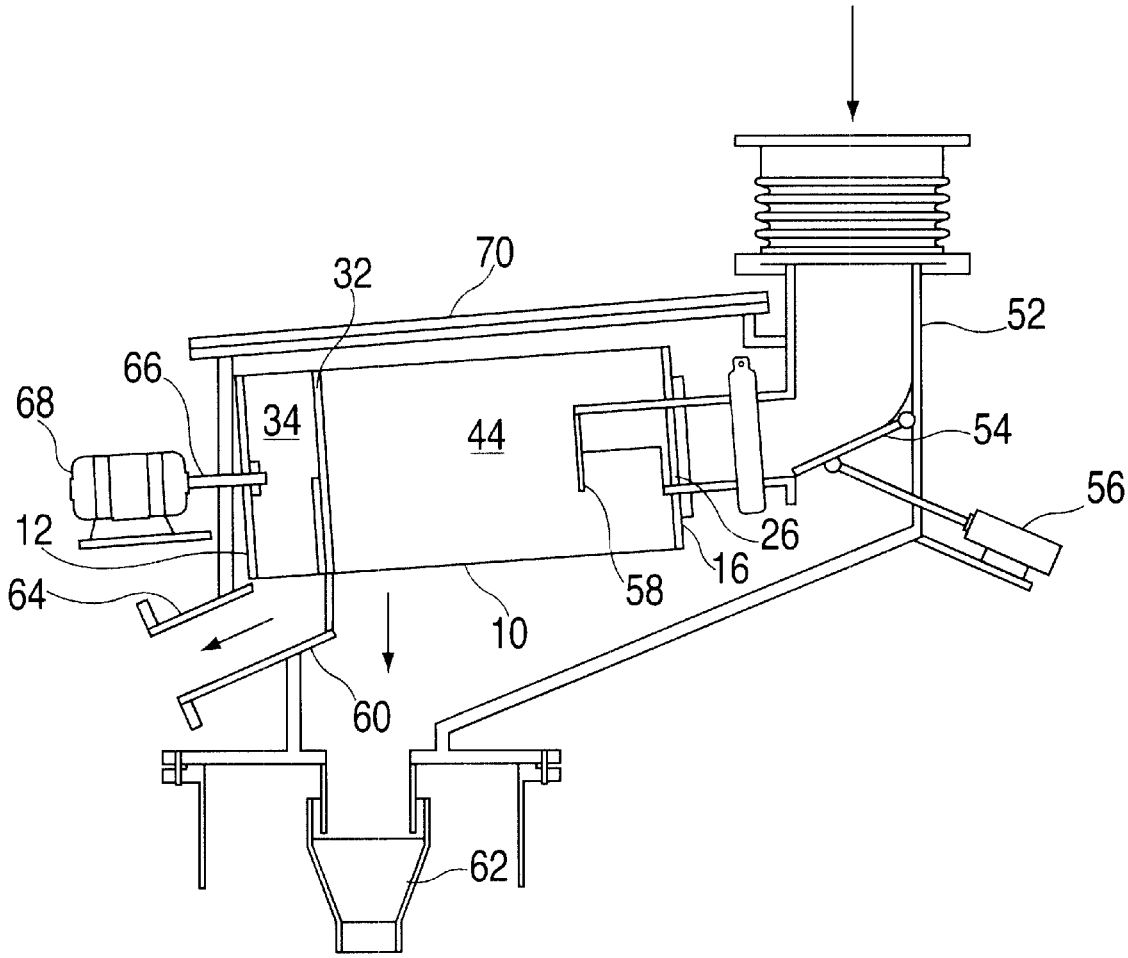
FIG. 6 is a schematic view of an embodiment of the invention in partial cross section.

FIG. 6 demonstrates a non-limiting use example for the trommel 10. The trommel 10 may be mounted within the flow path of materials to be segregated by size.

In the embodiment shown, the canted trommel 10 is disposed in a transition zone between a bucket elevator and a segregator.

The articles or elephants are dropped into an elbow 52 having a by-pass gate 54 driven by an actuator 56. In order to slow down and disrupt the momentum of the flow of the elephants to the trommel 10, a chain 58 hangs from the end of the elbow 52 within the trommel 10 just after the opening 26.

The trommel 10 is housed within a segregator 70. An internal divider 60 essentially collinear with the rod support ring 32, captures the smaller fractions falling out of the trommel 10 from the classifying zone 44 into funnel 62. The larger pieces pass through the discharge zone 34 into the oversize discharge 64.

The drive motor 68 rotates the trommel 10 by virtue of the shaft 66 affixed to the drive hole 22.

In tests, the trommel 10 was fed with bed pellets that discharge from a tote bin into a small funnel connected to a 5 inch (12.7 cm) schedule 40 pipe and 90 degree elbow 52. The elbow 52 extends into the trommel 10 about 5 inches (12.7 cm). Half of the diameter of this pipe was cut away and a circular plate was welded to the end. The elbow 52 discharge area was 29 cubic inches (4.75.2 $cm^3$). The chain 58 hangs in front of the cut away pipe.

The maximum feed rate attained was 75–82 tonnes (75,000–82,000 kg) per hour with bed pellets and additions of various size chunks (about 10 per test). This flow rate did not change when the trommel 10 was not rotating. Initially, tests were conducted at 18 RPM at a canted trommel 10 slope of 1.1 degrees. Under these conditions 0.1% of the bed pellets were contained in the oversize fraction due to pellet momentum and deflection from the rods 42. On occasion some chunks ¾ by 2 by 2 inches (1.9×5.1×5.1 cm) passed through the 1 inch (2.54 cm) spacing into the undersize fraction. When the rate was lowered to 5 rpm, only 0.01% of bed pellets were contained in the oversize fraction. All large chunks and pellets were removed including the largest chunk at 2 by 3 by 5 inches (5.1×7.62×12.7 cm). No plugging occurred.

Additional successful tests using other fractions resulted in flow rates in excess of 100 tonnes (100 kg) per hour. It was determined that an elbow 52 having a 45° angle orientation from the vertical (as opposed to the 90° angle orientation depicted) permitted slightly higher flow rates.

The trommel 10 may be operated solo, that is, by itself where essentially two different sized fraction ranges will be culled from a components stream. Alternatively, a plurality of variously sized ganged trommels 10 may be operated in tandem either nested within one another and/or daisy chained in sequential fashion to cull a plurality of sized fraction ranges.

Figure 7:
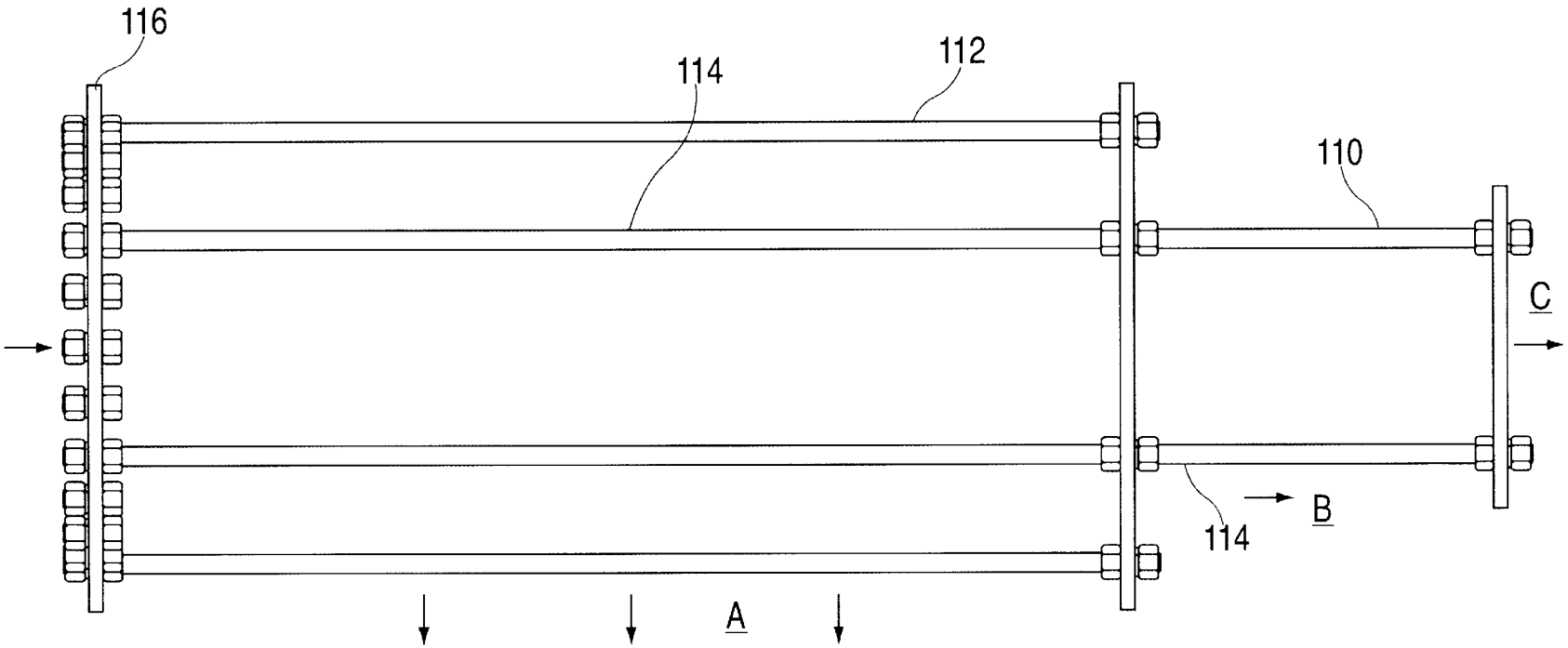
FIG. 7 is a schematic alternative embodiment of the invention.

For example, in FIG. 7, a first trommel 110 is nested within a second trommel 112 of larger diameter and rotated by a common drive (not shown). A number of support rods 114 are shared. For simplicity, most rods and components are not shown. The gaps between the various rods of the trommel 114 are greater than the gaps between the rods in the trommel 112. In this configuration, the objects are fed through feed plate 116. Fine particles will exit the nested trommels 110/112 at location A. Middle sized particles will exit at location B and course particles will emerge at location C.

Figure 8:
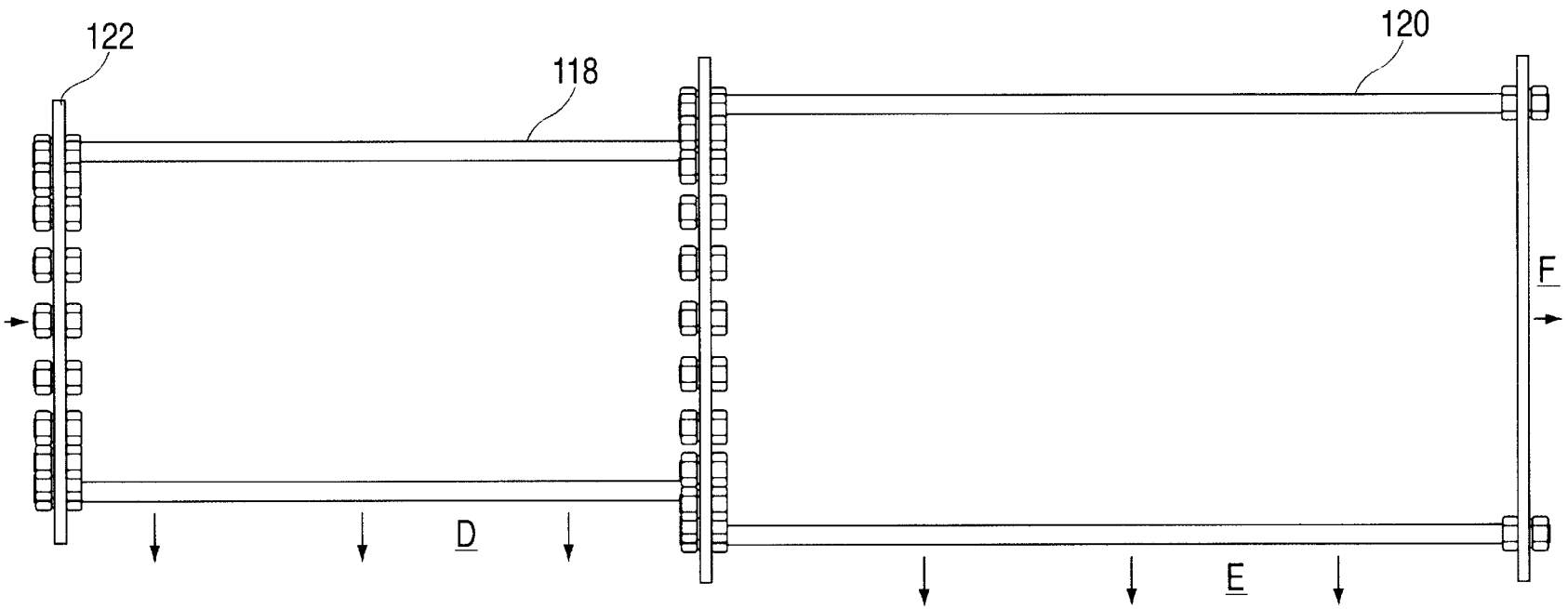
FIG. 8 is a schematic alternative embodiment of the invention.

Alternatively, FIG. 8 depicts the trommels in a sequential configuration. Smaller diametered trommel 118 precedes larger trommel 120. Again components may be shared as in the nested configuration of FIG. 7 or they may be independent. In this sequential example, the gaps of the rods in the trommel 118 are less than the gaps of the rods in the trommel 120. As the trommels 119/120 are rotated objects are fed through the feed plate 122. Fine particles are discharged in zone D. Middle particles are discharged from zone E and course particles emerge from zone F.

The trommel easily lends itself to numerous configurations, combinations, and sizes. If more than one trommel 10 is desired, the trommels may be connected together or be independent of one another. Moreover, the rotation of the trommels may be modulated as needed. One may rotate clockwise whereas a companion trommel may rotate counterclockwise.

By employing a myriad number of ganged trommels 10, a multiple of classified objects and articles may be expediously culled in a single pass.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

What is claimed is:

1. A trommel for classifying objects, the trommel comprising a distal drive plate and an opposed proximal feed plate, a first plurality of first spaced longitudinal members extending between the distal drive plate and the proximal feed plate and forming an open cylinder, a member support ring disposed within the open cylinder, the member support ring having an interior periphery, a second plurality of second spaced longitudinal members having distal ends and proximal ends extending between the member support ring and the proximal feed plate respectively, the proximal ends of the second spaced longitudinal members in fixed contact with the proximal feed plate and the distal ends of the second spaced longitudinal members in a free, unattached, and unrestrained floating relationship with the inner periphery of the member support ring so as to move in essentially infinite degrees of freedom, the proximal feed plate and the member support ring forming a classifying zone therebetween, and the member support ring and the distal drive plate forming a discharge zone therebetween.

2. The trommel according to claim 1 wherein the interior periphery of the member support ring includes a plurality of scallops.

3. The trommel according to claim 2 including first and second scallops.

4. The trommel according to claim 2 wherein the first and second spaced longitudinal members are at least partially circumscribed by their corresponding scallops.

5. The trommel according to claim 4 wherein the first spaced longitudinal members are affixed to their corresponding scallops.

6. The trommel according to claim 4 wherein the second spaced longitudinal members float within their corresponding scallops.

7. The trommel according to claim 1 wherein the first spaced longitudinal members are affixed to the interior periphery of the member support ring.

8. The trommel according to claim 1 wherein the second spaced longitudinal members are adjacent to the interior periphery of the member support ring.

9. The trommel according to claim 1 wherein the feed plate includes a central opening.

10. The trommel according to claim 1 wherein the first spaced longitudinal members are attached to the distal drive plate and the proximal feed plate, and the proximal ends of the second spaced longitudinal members are attached to the proximal feed plate.

11. The trommel according to claim 1 including means for rotating the trommel.

12. The trommel according to claim 1 including an object feeder communicating with the feed plate.

13. The trommel according to claim 1 wherein the trommel is disposed within a segregator.

14. The trommel according to claim 1 wherein the distal ends of the second spaced longitudinal members are adapted to flex and oscillate vis-à-vis themselves, the first spaced longitudinal members and the inner periphery of the member support ring.

15. The trommel according to claim 1 including a repeating pattern of first spaced longitudinal members and second spaced longitudinal members.

16. The trommel according to claim 1 wherein the first spaced longitudinal members, and the second spaced longitudinal members are disposed adjacent to the inner periphery of the member support ring thereby creating an unencumbered object flow path between the classifying zone and the discharge zone.

17. The trommel according to claim 1 wherein at least a first trommel is nested within at least a second trommel.

18. The trommel according to claim 1 wherein at least a first trommel sequentially follows at least a second trommel.

* * * * *